US005484072A

United States Patent [19]

Beck et al.

[11] Patent Number: 5,484,072

[45] Date of Patent: Jan. 16, 1996

[54] SELF-STANDING POLYESTER CONTAINERS FOR CARBONATED BEVERAGES

[75] Inventors: Martin H. Beck, Merrimack; George F. Rollend, Amherst; John H. Muszynski, Auburn, all of N.H.

[73] Assignee: Hoover Universal, Inc., Plymouth, Mich.

[21] Appl. No.: 209,392

[22] Filed: Mar. 10, 1994

[51] Int. Cl.[6] ..... B65D 23/00

[52] U.S. Cl. ..... 215/375; 215/381; 220/609; 264/523; 264/532

[58] Field of Search ..... 215/1 C, 371, 215/372, 373, 374, 375, 377, 381; 220/606, 608, 609; 264/523, 532, 537

[56] References Cited

U.S. PATENT DOCUMENTS

| | | | |
|---|---|---|---|
| 3,759,410 | 9/1973 | Uhlig . | |
| 3,837,517 | 9/1974 | Held, Jr. | 215/1 C |
| 4,108,324 | 8/1978 | Krishnakumar et al. . | |
| 4,247,012 | 1/1981 | Alberghini . | |
| 4,254,882 | 3/1981 | Yoshino . | |
| 4,403,706 | 9/1983 | Mahajan . | |
| 4,525,401 | 6/1985 | Pocock et al. . | |
| 4,785,950 | 11/1988 | Miller et al. | 215/1 C |
| 4,863,046 | 9/1989 | Collette et al. . | |
| 4,865,206 | 9/1989 | Behm et al. . | |
| 4,867,323 | 9/1989 | Powers . | |
| 4,892,205 | 1/1990 | Powers et al. . | |
| 4,927,680 | 5/1990 | Collette et al. . | |
| 4,978,015 | 12/1990 | Walker . | |
| 5,024,340 | 6/1991 | Alberghini et al. | 215/1 C |
| 5,071,015 | 12/1991 | Kinslow | 215/375 |
| 5,160,059 | 11/1992 | Collette et al. | 215/1 C |
| 5,205,434 | 4/1993 | Brunson et al. | 215/1 C X |
| 5,287,978 | 2/1994 | Young et al. | 215/1 C |
| 5,320,230 | 6/1994 | Hsiung | 215/1 C |
| 5,427,258 | 6/1995 | Krishnakumar et al. | 264/523 X |

FOREIGN PATENT DOCUMENTS

91/00138 1/1992 Australia .

*Primary Examiner*—Gary E. Elkins
*Assistant Examiner*—Christopher J. McDonald
*Attorney, Agent, or Firm*—Davis, Bujold & Streck

[57] ABSTRACT

The invention provides a self-standing blow molded two liter carbonated beverage bottle 1 weighing under 50 grams and having a unique petaloid base 7. The base comprises a petaloid design which has a plurality of at least three (preferably five) feet 9. Between each adjacent pair of feet is a radially extending valley 12 the width of which decreases with increasing radial distance from the bottles longitudinal axis toward a point of convergence 14 radially outside the bottle's diameter. The valley floor generally follows the hemispherical base shape and opens to an extended portion 13 of that base shape lying radially outwardly of the feet. The valley and extended portion initial pressurization of the bottle, deformation of the extended portions outwardly with a resulting raising of the center of the base away from the support surface.

13 Claims, 4 Drawing Sheets

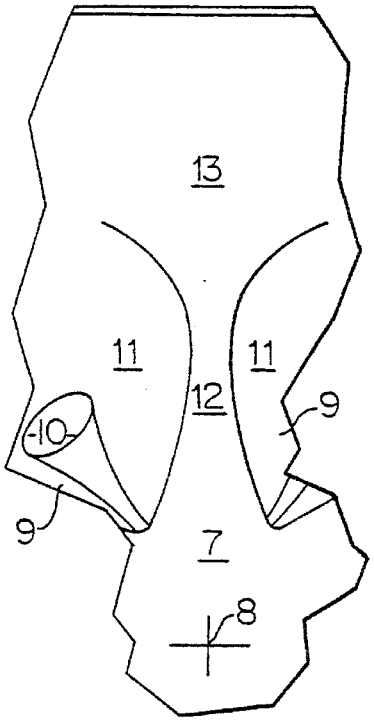
FIG.8
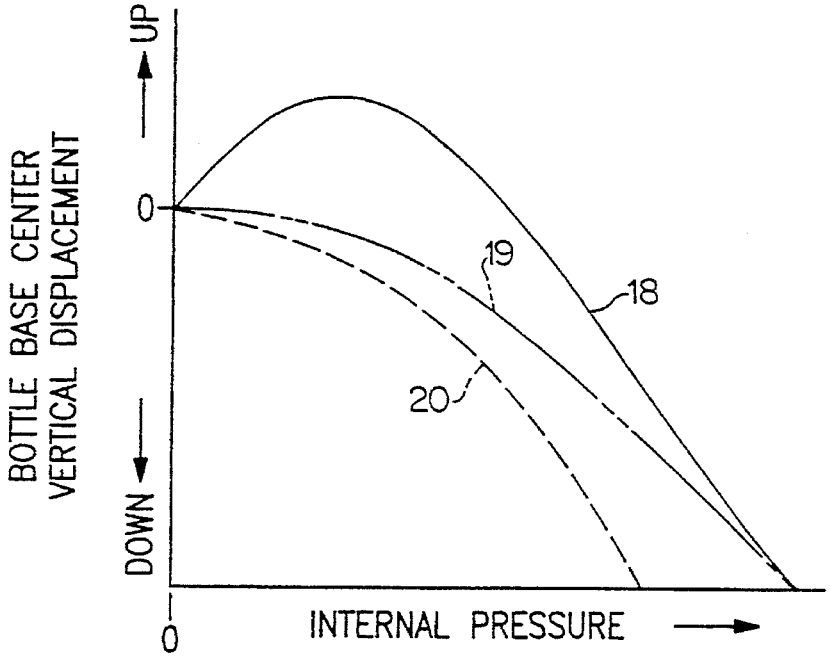
FIG.9
FIG.10
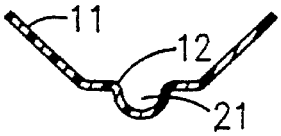

SELF-STANDING POLYESTER CONTAINERS FOR CARBONATED BEVERAGES

This invention relates to self-standing containers, preferably bottles, having petaloid bases, for carbonated beverages. Particularly, though not exclusively, the containers comprise biaxially oriented polyester bottles, preferably polyethylene terephthalate (PET), and are manufactured by stretch blow molding.

"Petaloid" is a term of art well understood by those involved in the technology to which this invention relates. However, for the sake of clarity "petaloid" as used herein shall mean "a multi-footed base shape for a self-standing container in which a plurality of feet are disposed in the base portion of the container, somewhat in the general configuration of a plurality of petals" (as in a flower) to provide a stable multi-point self-standing support for the container.

BACKGROUND OF THE INVENTION

Polyester bottles, for carbonated beverages, having petaloid bases to provide a self-standing ability with a one piece construction are known in the prior art and are commercially available. Such prior art bottles have been constructed of biaxially oriented PET by the known process of blow molding. These prior art one piece bottle constructions have permitted the commercially viable mass production of self-standing beverage containers without the use of a separate base molding utilized in earlier constructions in which the base of the bottle was hemispherical and rendered self-standing by the addition of a separate base unit attached to the hemispherical base by an adhesive. Such two piece constructions do not lend themselves to recycling and were relatively expensive in terms of material and production costs.

Production costs and, more particularly, material costs has led in recent years to substantial research and development in attempts to produce a commercially viable self-standing one piece bottle, for carbonated beverages, which can be produced economically and which performs reliably both in terms of storage and transportation as well as the ability to provide reliable and stable self-standing performance in use.

While this prior art research and development has led to commercially viable products, the viability of these products has been achieved at the expense of the incorporation of additional material to provide the required bottle integrity and stability for commercial use. This additional material was necessitated by the need to design the base of a one-piece bottle which provides a self-standing ability with the consequent elimination of the simple, lightest and most strength effective prior art base form, namely the hemisphere.

Prior art designs, utilizing a hemispherical base, constructed of biaxially oriented PET, such as are found in the commercial market, typically weigh between 46 and 48 grams in the 2 liter size (to this must be added 13 to 16 grams of polyethylene or other plastic material in the separate base which is attached to the hemispherical base to provide standing stability). By comparison, present day commercially available self-standing petaloid base biaxially oriented PET 2 liter bottles weigh from 50 to 56 grams with an average weight of approximately 53.5 grams.

Based on a conservative estimate of 5 billion bottles produced per year and a PET price of $(US)0.7 per pound, a 1 gram increase in the PET content of a bottle will cost approximately $(US)7.7 million per year. Consequently, although the separate polyethylene base is eliminated, the achievement of one-piece self-standing 2 liter PET bottles, meeting the necessary integrity and stability requirements of the industry, as they are currently available has resulted in an increased PET material cost, on the basis of 5 billion bottles per year, of approximately $(US)50 million.

It is an object of the present invention to provide a self-standing petaloid base biaxially oriented polyester bottle for carbonated beverages which is significantly lighter in weight than existing commercially available petaloid base bottle designs without any significant increase in production costs and while meeting industry requirements with respect to integrity and stability during storage, transportation and use.

It is also an object of the present invention to provide improved stress crack resistance of the base.

SUMMARY OF THE INVENTION

The light weight biaxially oriented polyester bottle of the present invention achieves weight savings of the polyester material, relative to existing designs of self-standing bottle of similar capacity by the use of unique design concepts relating to the design of its petaloid base. By the use of the unique design features of the present invention, the production of the biaxially oriented PET 2 liter self-standing polyester bottles having a material weight of less than 50 grams, probably as low as 48.0 or even 47.5 grams, while meeting the industry requirements for integrity and stability, is commercially viable. 47.5 grams is within the PET weight range of prior art 2 liter hemispherical base prior art 2 liter biaxially oriented PET carbonated beverage bottles and is 6 grams per bottle lighter than the presently commercially available petaloid base self-standing biaxially oriented PET bottles. The consequence is a material saving, based on 5 billion bottles per year, of approximately $(US)50 million, based on a PET price of $(US)0.7 per pound. This results in a commercially viable 2 liter PET bottle without the PET weight disadvantage of currently commercially available petaloid base self-standing 2 liter bottle designs, while at the same time eliminating the need for the production and use of separate environmentally unsatisfactory polyethylene bases necessitated when hemispherical bases are utilized.

According to the invention there is provided a self standing blow molded polyester container, defining a longitudinal axis, for carbonated beverages having a neck finish integral with and terminating in a neck portion which is integral with and terminates in a side wall portion which is integral with and terminates in a closed base; the neck portion, side wall portion and the base being biaxially oriented; and the base being of a petaloid form defining at least three feet disposed about the longitudinal axis whereby the container is self standing, characterized in that circumferentially adjacent pairs of the feet define, support, and are separated by, relatively stiff valleys each extending substantially radially from a central region of the base, centered on the longitudinal axis, to a relatively deformable open area located radially outwardly of the feet whereby initial internal pressurization of the container will deform the open areas outwardly away from the longitudinal axis to pivot the valleys about their support by the feet thereby to move the central region of the base along the longitudinal axis toward the neck finish.

Also according to the invention there is provided a method of producing a self standing blow molded polyester container, defining a longitudinal axis, for carbonated beverages having a neck finish integral with and terminating in a neck portion which is integral with and terminates in a side wall portion integral with and terminates in a closed base; the neck portion, side wall portion and the base being biaxially oriented; and the base being of a petaloid form defining at least three feet disposed about the longitudinal axis to whereby the container is self standing, characterized by a) providing radially extending relatively rigid valleys between and supported by adjacent pairs of the feet; b) providing relatively deformable areas adjacent radially outer ends of the valleys; c) providing a relatively rigid central region, of the base centered on the longitudinal axis, from which the valleys extend radially; and d) selecting the relative rigidity of the valleys and central region, the support provided by the feet and the relative deformability of the areas whereby upon initial internal pressurization of the container the areas deform outwardly to pivot the valleys about their support by the feet to displace the central region against the internal pressure along the axis toward the neck finish.

BRIEF INTRODUCTION TO THE DRAWINGS

The invention will now be described, by way of example, with reference to accompanying drawings, in which:

FIGS. 3A–7A are diagrammatic inverted (relative to FIG. 1) fragmentary cross-sections taken on Section Lines 3—3 through 7—7 respectively as shown in FIGS. 1 and 2;

FIGS. 3B–7B are diagrammatic representations of centerlines defining the center of material wall thickness illustrated respectively in FIGS. 3A–7A with projection lines illustrating the effective valley widths of the cross-sections illustrated in FIGS. 3A–7A;

FIG. 8 is a fragmentary view taken in the direction 8—8 of FIG. 1;

FIG. 9 is a graphical representation of the deformation of the base of a bottle according to the present invention taken against internal bottle pressure; and FIG. 10 is a diagrammatic fragmentary cross-section of a valley similar to those illustrated in FIGS. 3A–6A with the addition of a longitudinally extending reinforcement ridge.

DETAIL DESCRIPTION OF THE INVENTION

Briefly, the base of the preferred form of container of the present invention comprises a petaloid design for a bottle which has a plurality of at least three (preferably five) feet evenly disposed around the longitudinal axis of the bottle and projecting from a hemispherical base form of the bottle to provide a stable self-standing support for the bottle. Between each adjacent pair of feet is a radially extending valley, the valley floor of which is preferably curved in cross-section (in one form a secondary fold or radially extending ridge stiffens and reinforces the valley floor). The valley width decreases with increasing radial distance from the bottles longitudinal axis so that the walls of the valley tend toward a point of convergence radially outside the bottle's diameter. The valley floor generally follows the hemispherical base shape and opens to an extended portion of that base shape lying radially outwardly of the feet.

The shape, dimensions and material thickness etc. of the valley and extended portion are chosen so that initial pressurization of the bottle tends to expand and deform the extended portions outwardly with a resulting raising of the center of the base, at the longitudinal axis, away from the support surface. Further pressurization will reverse this and the center of the base may return at least to its unpressurized location. This action reduces the downward destabilizing deformation of the center of the base as compared with existing petaloid base designs and permits a lighter construction while still meeting industry performance requirements.

Figure 1:
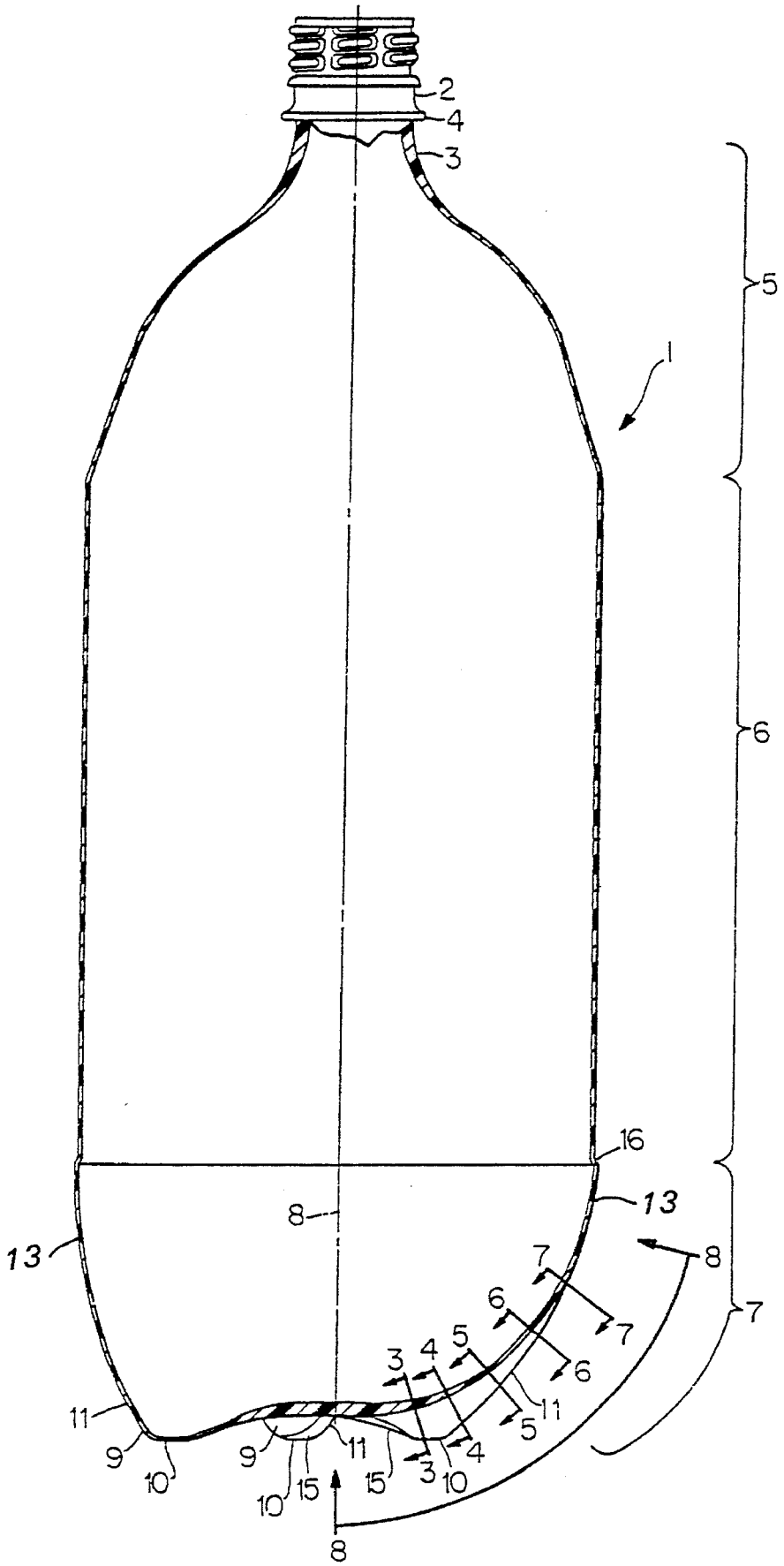
FIG. 1 is a fragmentary part cross-sectional elevation of a bottle according to the present invention taken on Section Line 1—1 of FIG. 2.
Figure 2:
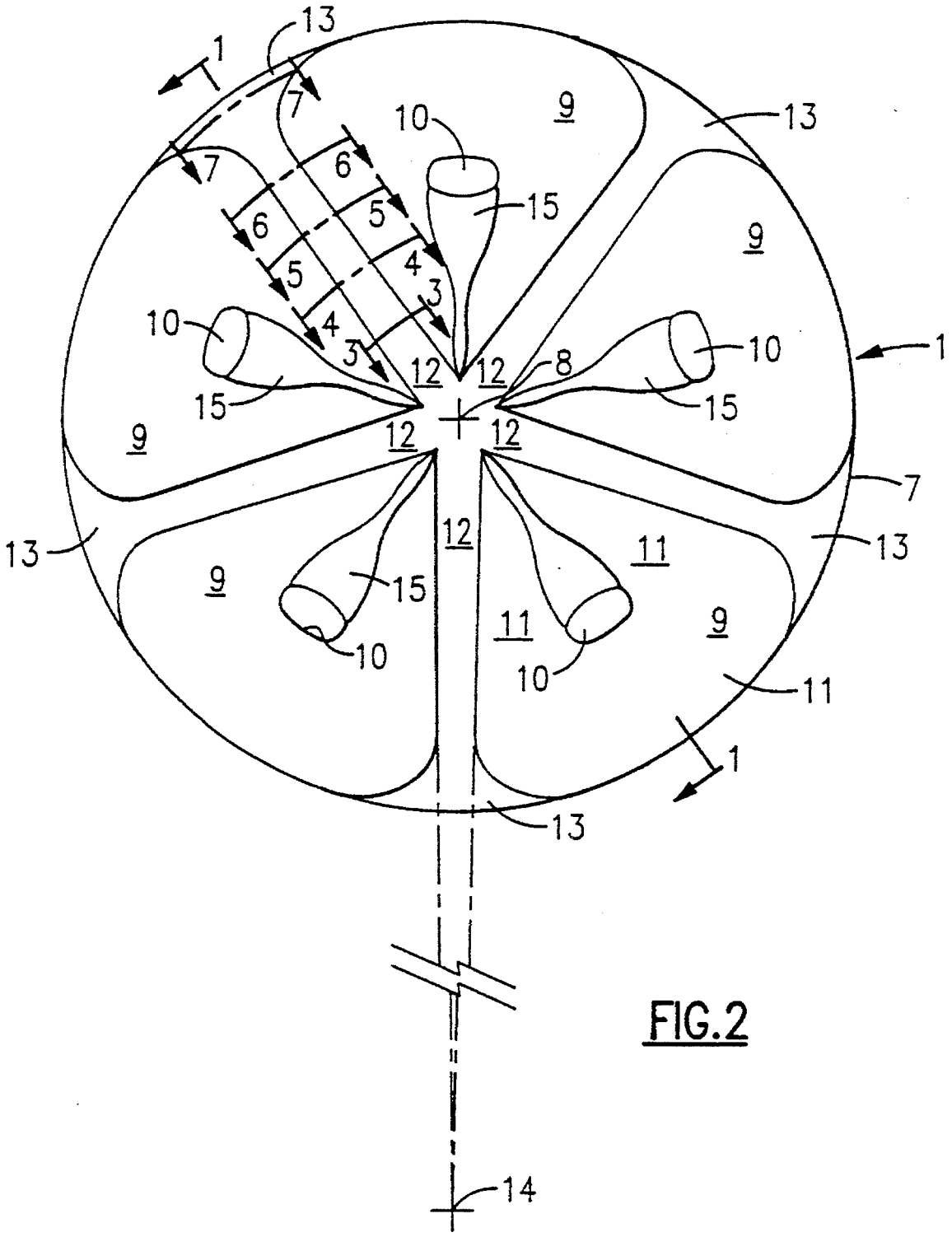
FIG. 2 is an underview of the bottle illustrated in FIG. 1.

Referring first to FIGS. 1 and 2, a one piece self-standing biaxially oriented PET two liter bottle 1, of circular horizontal cross-section, comprises a neck finish 2 connected to a neck transition portion 3 of the bottle by way of a neck support ring 4. The neck transition portion 3 connects by way of an upper portion 5 of the bottle to a substantially cylindrical side wall portion 6 which terminates at its lower end in a closed base 7, the underlying shape of which is hemispherical. The bottle 1 defines a longitudinal axis 8.

Projecting downwardly from the hemispherical form of the base are five hollow feet 9 which together form a petaloid foot formation with the feet symmetrically and evenly disposed about the longitudinal axis 8 to provide the stable support for the bottle necessary to provide its self-standing ability. The lowest extensions of the feet 9 terminate in bottle support pads 10. Each foot 9 comprises sloping walls 11 extending from its pad 10 to its junction with the underlying hemispherical formation (reference numbers for sloping walls 11 are illustrated in FIG. 2 only with respect to one of the feet although all of the feet are identical).

Radially extending valleys 12 are disposed between adjacent pairs of feet 9. These valleys 12 each include a valley floor which substantially follows the surface curvature of the underlying hemispherical shape of the base 7 and terminates at and open into an extended portion 13 (see FIG. 8). Although shown by solid lines (FIG. 2) for simplicity at the junctions between the sloping walls 11 and the valleys 12 and pads 10, the intersection of these elements are curved in cross-section to provide smooth transitions and structural rigidity of the valleys along their length.

All of the valleys 12 are substantially identical and each valley converges in effective width toward a point of convergence 14 lying outside of the outer diameter of the bottle 1 (FIG. 2).

The central area of the base 7, through which extends the axis 8 is connected to each pad 10 by a substantially flat ridge path 15 joined on either side to portions of the sloping walls 11.

The bottle illustrated includes a small annular lip 16 which is primarily present for aesthetic purposes and for label alignment during production. This lip lies adjacent the transition from the sidewall 6 to the base 7.

With particular reference to FIG. 1 it will be noted that although the bottle is illustrated in cross-sectional form and although the material of the bottle will usually be substantially transparent, details of the interior of the bottle, lying beyond a cross-section taken are omitted for the sake of clarity in the illustration of the invention.

Now referring to FIGS. 3A/B through 7A/B the structure of one of the five identical valleys will be described. In each of the five cross-sections the A designation indicates a fragmentary cross-section of the valley concerned while the "B" designation represents the center of thickness of material, shown in the associated "A" designation cross-section, with projection lines illustrating the effective structural valley width of that associated cross-section.

Figure 3A:
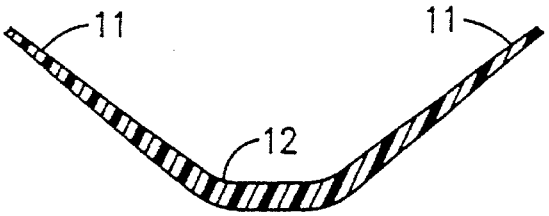
Figure 3B:
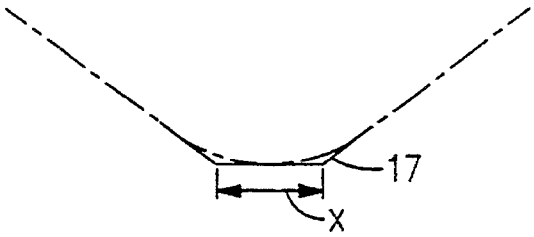
Figure 4A:
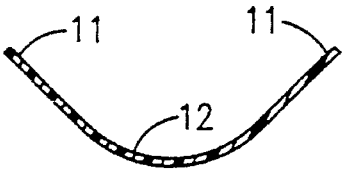
Figure 4B:
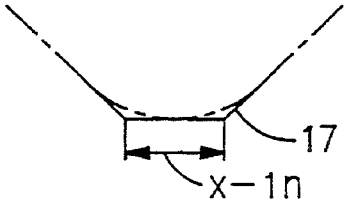
Figure 5A:
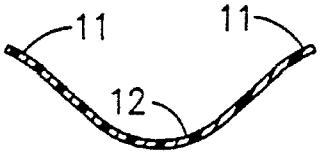
Figure 5B:
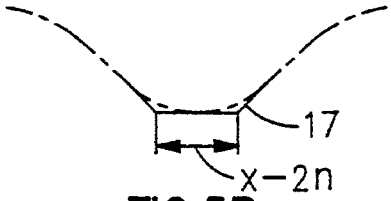
Figure 6A:
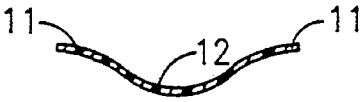
Figure 6B:
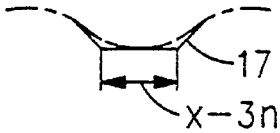

FIG. 3A, taken on Section Lines 3—3 of FIGS. 1 and 2, is the valley cross-section closest to the longitudinal axis 8 of the bottle and illustrates the increased thickness of the material of the bottle in the region of the longitudinal axis 8 and the portion of the valley most closely adjacent that axis. The variation of the base thickness along the length of the valley is best illustrated to the right of the longitudinal axis 8 in FIG. 1. The increased thickness in the central area of the base of the bottle is required to prevent inversion (excess downward deformation) of the central area of the base in use (storage, transportation and beverage consumption related activities) when pressurized by a carbonated beverage. FIGS. 4A, 5A and 6A illustrate fragmentary cross-sections of the valley at the Section Lines 4—4, 5—5 and 6—6 of FIGS. 1 and 2 and show the decreasing depth and width of the illustrated valley the radial distance, from the longitudinal axis 8 increases. The construction lines 17 of FIGS. 3B–6B represent an extension of the sloping wall 11 to the base of the valley in order to illustrate the effective width of the valley as it decreases with an increase in radial distance from the axis 8. This reduction in width is shown by the dimension X, X–1n, X–2n and X–3n in FIGS. 3B, 4B, 5B and 6B, respectively, with X being the respective width of the valley at the cross-section 3—3 and n being a number representative a decrease in effective valley width from illustrated section to illustrated section.

Figure 7A:
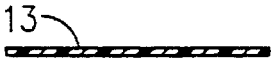
Figure 7B:
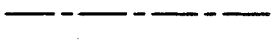

FIGS. 7A and B illustrate a cross-section of the base of the bottle in the extended portion 13 radially outside of the cross-section illustrated in 6A and into which the valley opens. The extended portion 13 represents an area of the base adjacent its greatest diameter and close to the transition from the base to the sidewall portion The extended portion extends around a substantial portion of the circumference of the base to define a relatively deformable region of the base adjacent and in communication with the radially outer end of each valley. In addition to the figures already discussed, reference should be made to FIG. 8 which illustrates the relationship between each valley and its associated extended portion of the base.

The relatively deformable extended portions 13 and the relatively rigid valleys 12 supported by the relatively rigid feet 9 together serve to allow the construction of the present invention to perform in a manner meeting the integrity and stability requirements of the industry while enjoying a substantial reduction in weight (from an average of 53½ grams to approximately 47½ grams for a two liter bottle) by comparison with existing petaloid based self-standing biaxially oriented PET two liter bottles for carbonated beverages.

The described elements of the present invention function to provide the superior performance as follows. Upon initial pressurization of the bottle,the extended portions are deformed outwardly with a resulting application of force to pivot the substantially rigid levers, provided by the valleys 11, about a substantially rigid pivotal location provided by the substantially rigid feet 9 with the consequent uplifting of the central region of the base of the bottle at the location of the longitudinal axis 8, namely the area of the base of the bottle which is most prone to inversion (excessive downward deformation) upon the application of internal pressure to the bottle. This effect increases during an initial increase in internal pressure in the bottle until limitations in the deformation of the extended portions 13 and of the rigidity of the valleys 11 and feet 9 result in the internal pressure in the bottle overcoming the upward bias of the central portion of the base and reversing that upward deformation until the central portion adjacent the location of the longitudinal axis 8 is deformed downwardly to and past its location when zero pressure is applied internally to the bottle. Thus, a substantial internal pressure is supported in the bottle before the central portion of the base begins to deform downwardly, below its zero pressure location, thereby facilitating the required performance of the bottle with respect to integrity and stability at a substantially lighter material weight than that of prior art petaloid bottles in which the deformation of the corresponding central region of the base in a downward direction commences immediately upon the application of pressure to the inside of the bottle.

With reference to FIG. 9 there is illustrated a graphical representation of the deformation characteristics of the central portion of the base of a bottle a) according to the present invention (solid line 18) with b) a typical prior art petaloid base bottle (chain dashed line 19) weighing approximately 6 grams more than the bottle of the present invention and c) the projected deformation (dashed line 20) of a petaloid based two liter biaxially oriented PET bottle similar to that already existing in the prior art but with a weight reduction in the base area of the bottle corresponding to the weight reduction achieved by the present invention but without the innovative design characteristics of the base portion of the present invention. As Can be seen, the central base region of the bottle of the present invention is deformed upwardly with an initial increase in internal pressure of the bottle from zero and then, with a further increase in internal pressure, returns to its initial zero pressure position and passes through that position to a downward deformation as internal pressure is further increased. The heavier existing prior art bottle represented by the deformation curve 19, shows a continuous downward deformation of the central region of the base from the initial application of internal pressure. Both the bottle of the present invention and the existing heavier prior art bottle represented by the deformation curves 18 and 19 are able to meet industry standards for integrity and stability. However, the projected curve 20 of a lightened prior art bottle otherwise similar to the bottle resulting in the performance curve 19, shows a markedly increased deformation of the base region of the bottle which will result in premature failure or excessive deformation which will not permit that bottle to meet the aforementioned industry standards. Deformation curves 18 and 19 are diagrammatic representations of actual test results while the deformation curve 20 is an illustration of the projected deformation of the bottle concerned extrapolated from the known deformation characteristics of the known prior art bottles and stress analysis of such a bottle with the decreased base weight involved.

FIG. 10 shows variation on the embodiment illustrated in FIGS. 1–8. In this embodiment, each of the valleys 12 includes in its floor a ridge or secondary fold 21 extending along its length to additionally stiffen the valley. The ridge 21 may extend for substantially the entire length of the valley from the cross-section illustrated in FIG. 3A to the cross-section illustrated in FIG. 6A.

We claim:

1. A self standing blow molded polyester container, defining a longitudinal axis, for carbonated beverages having a neck finish integral with and terminating in a neck portion which is integral with and terminates in a side wall portion which is integral with and terminates in a closed base portion; the neck portion, side wall portion and the base portion being biaxially oriented; and the base portion being of a petaloid form defining at least three feet disposed about the longitudinal axis whereby the container is self standing, characterized in that:

circumferentially adjacent pairs of the feet define, support, and are separated by, relatively stiff valleys each extending substantially radially from a central region of the base portion, centered on the longitudinal axis, to a relatively deformable, compared to the relatively stiff valleys, open area of the base portion located radially outwardly of the feet and adjacent to a maximum diameter of said base portion;

wherein the relative stiffness and deformability of the valleys and the open area are selected such that initial internal pressurization of the container will, due to the relative deformability of the open area, deform the open area radially outwardly away from the longitudinal axis, which in turn moves radially outer ends of the relatively stiff valleys radially outwardly away from the longitudinal axis, which in turn, due to the stiffness of the valleys relative to the open area, rocks the valleys about their support by the feet and moves radially inner ends of the valleys generally upwardly toward the neck finish, thereby moving the central region of the base portion along the longitudinal axis toward the neck finish.

2. A container according to claim 1 characterized in that the central region is of greater thickness than the remainder of the base whereby the central region acts as a substantially rigid diaphragm.

3. A container according to claim 2 characterized in that the underlying shape of the base is hemispherical and that the central region, valley floors and open areas substantially conform to the hemispherical shape.

4. A container according to claim 3 characterized in that the valleys have a rounded concave cross-section providing a smooth transition to the walls of the feet.

5. A container according to claim 4 characterized in that there are five substantially identical said feet supporting and separating five substantially identical said valleys, the feet and valleys being symmetrically and evenly disposed about the longitudinal axis.

6. A container according to claim 5 characterized in that the valleys are each provided with a radially extending reinforcing ridge.

7. A container according to claim 6 characterized in that the ridges extend into each valley floor.

8. A container according to claim 1 characterized in that the valleys converge in width each toward a point of convergence lying radially outwardly of the bottle.

9. A container according to claim 1 characterized in that the material thickness of the central region is greater than that of the open areas and the central region is non-deformable relative to the open areas.

10. A container according to claim 1 characterized by having a capacity of two liters and a weight of under 50 grams.

11. A container according to claim 10 characterized in that the weight is under 48 grams.

12. A container according to claim 8 characterized in that the material thickness of the central region is greater than that of the open areas and the central region is non-deformable relative to the open areas; and the material thickness of valleys diminishes from a thickness that is substantially equal to the material thickness of the central region at radially inner ends of the valleys to a thickness that is substantially equal to the material thickness of the open areas at the radially outer ends of said valleys.

13. A method of producing a self standing blow molded polyester container, defining a longitudinal axis, for carbonated beverages having a neck finish integral with and terminating in a neck portion which is integral with and terminates in a side wall portion integral with and terminates in a closed base; the neck portion, side wall portion and the base being biaxially oriented; and the base being of a petaloid form defining at least three feet disposed about the longitudinal axis to whereby the container is self standing, characterized by:

a) providing radially extending relatively rigid valleys between and supported by adjacent pairs of the feet;

b) providing relatively deformable areas adjacent radially outer ends of the valleys and adjacent to and radially inwardly of a maximum diameter of said base portion;

c) providing a relatively rigid central region, of the base centered on the longitudinal axis, from which the valleys extend radially; and d) selecting the relative rigidity of the valleys and central region, the support provided by the feet and the relative deformability of the areas whereby upon initial internal pressurization of the container the areas deform outwardly to pivot the radially outer ends of the valleys radially outwardly about their support by the feet, move radially inner ends of the valleys generally upwardly toward the neck finish, and thereby to displace the central region against the internal pressure along the axis toward the neck finish.

* * * * *